US005787550A

United States Patent [19]

Bender

[11] Patent Number: 5,787,550

[45] Date of Patent: Aug. 4, 1998

[54] VEHICLE DOOR ON-DOOR OFF MOUNTING ARRANGEMENT

[75] Inventor: Frederick F. Bender, South Lyon, Mich.

[73] Assignee: Chrysler Corporation, Auburn Hills, Mich.

[21] Appl. No.: 474,844

[22] Filed: Jun. 7, 1995

[51] Int. Cl.[6] ..... E05D 5/00

[52] U.S. Cl. ..... 16/382; 16/DIG. 31

[58] Field of Search ..... 16/382, 248, 249, 16/DIG. 43

[56] References Cited

U.S. PATENT DOCUMENTS

| | | | |
|---|---|---|---|
| 1,485,432 | 3/1924 | Schoff | 16/272 |
| 2,620,505 | 12/1952 | Goulooze | 16/248 |
| 3,448,486 | 6/1969 | Wright | 16/324 |
| 4,087,942 | 5/1978 | Herrmann | 16/382 |
| 4,118,827 | 10/1978 | Yamamoto | 16/382 |
| 4,304,027 | 12/1981 | Di Fazio | 16/249 |
| 4,375,716 | 3/1983 | Armstrong et al. | 49/400 |
| 4,438,597 | 3/1984 | Maggart | 16/248 |
| 4,651,382 | 3/1987 | Krolick | 16/382 |
| 4,982,476 | 1/1991 | Salice | 16/382 |
| 5,054,165 | 10/1991 | Marchione | 16/270 |
| 5,067,201 | 11/1991 | Marchione | 16/270 |
| 5,088,154 | 2/1992 | Ishikawa | 16/382 |
| 5,095,582 | 3/1992 | Ohlsson | 16/235 |

*Primary Examiner*—Chuck Mah
*Assistant Examiner*—Donald M. Gurley
*Attorney, Agent, or Firm*—Thomas G. Pasternak

[57] ABSTRACT

An arrangement for precisely mounting a door on a vehicle body by a door on-door off hinge assembly. A door hinge flange has upper and lower transversely elongated slots and an intermediate rectangular tab opening symmetrically disposed on a common vertical axis. A tapping plate has a base formed with upper and lower bores and a central hook-like resilient tab member lanced-out from its base. The base mating face has a thermosetting film adhesive affixed thereto while an upper tapered locator pin extends therefrom adapted to pass through a door hinge flange clearance aperture and seat in a net hole in the door hinge web to establish a precise re-mounting location of the door hinge. Upon the tapping plate being hung on the flange inner surface, by virtue of the tab member being hooked through the flange tab opening, the locating pin extends through a clearance aperture in the door flange and a net hole in the base. As the door hinges are loose fitted to the body hinge flange prior to hanging the door on the body, the tapping plate and door hinge adjustably slide on the flange allowing the door and body panel outer surfaces to be precisely aligned. Upon the body moving through an assembly line painting stage curing the adhesive film and bonding the tapping plate face to the door flange inner surface.

12 Claims, 4 Drawing Sheets

VEHICLE DOOR ON-DOOR OFF MOUNTING ARRANGEMENT

FIELD OF THE INVENTION

This invention relates to arrangements for mounting automotive vehicle doors and, more specifically, to an arrangement for precisely mounting a door to a vehicle body by means of door on-door off hinge assemblies during a vehicle body assembly line operation.

BACKGROUND OF THE INVENTION

Door on-door off automotive door hinges relate to a system wherein the door is fully installed on the vehicle body at one stage of an assembly line and, during such installation, the door and body hinges are adjusted as necessary to achieve a proper fit between the door and the body. Thereafter, the door is removed from the body to allow for easier installation of body components (i.e. seats, instrument panel, etc.). The door is trimmed on its own line. The hinges are designed to enable the door to be quickly and easily reinstalled without the need for further adjustment of the door relative to the body.

One known system involves installing a fixed anchor plate on a door flange for a door hinge wherein a pair of oversize bolt holes are drilled in the door hinge web. The hinge is loosely mounted by a pair of shoulder bolts extending through the oversize holes for engagement in an aligned anchor plate and door flange threaded bores. The outboard shoulder bolt includes a net washer assembly having a washer hole sized to provide a close tolerance fit with its bolt shoulder together with a thermosetting adhesive film pre-applied to the mating side of the net washer. Upon the door and the body exterior surfaces being adjustably aligned, the hinge assembly bolts are tightened. Thereafter, the vehicle body is moved through a painting stage wherein the adhesive film is heated to its curing temperature thereby bonding the net washer to the hinge web. The door can then be removed to facilitate a trim operation while the bonded net washer maintains the positional relationship between the door hinge and vehicle door that was established earlier during the door fitting stage.

SUMMARY OF THE INVENTION

It is a feature of the present invention to provide an arrangement for precise door on-door off hinge assembly mounting of a vehicle door wherein the door hinges are loosely bolted to the door by means of an adjustable tapping plate and door hinge arrangement which enables the door to be fitted to the body prior to the hinge assembly bolts being tightened.

It is another feature of the present invention to provide an arrangement for precise door on-door off hinge assembly mounting of a vehicle door wherein a thermosetting film adhesive, pre-applied to the tapping plate face adapted to mate with the door flange inner surface, is heat cured as the body moves through an assembly line painting stage whereby the tapping plate is bonded to the door flange.

It is yet another feature of the present invention to provide an arrangement for precise door on-door off hinge assembly mounting of a vehicle door wherein the tapping plate has a principal locator pin at its upper end extending through a clearance aperture in the door flange for close tolerance reception in a door hinge web net hole. Upon the tapping plate being bonded to the door flange, the locator pin establishes a precise re-installed location for the door by virtue of locator pin being received in its net hole.

It is another feature of the present invention to provide an arrangement for precise door on-door off mounting of a vehicle door hinge assembly wherein the tapping plate is readily secured, in a floating manner, on an inner surface of a door hinge panel by means of a hook-like central spring tab, lanced-out from the tapping plate base. Upon the tab being resiliently hooked through a rectangular opening in the door flange, the tapping plate tab is free to slide in and out on the door flange inner surface allowing the door hinge to be readily adjusted cross car to align the door to the vehicle body.

These and other features and advantages of the invention will be more fully understood from the following detailed description of the invention taken together with the accompanying drawings.

DETAILED DESCRIPTION OF THE INVENTION

Figure 1:
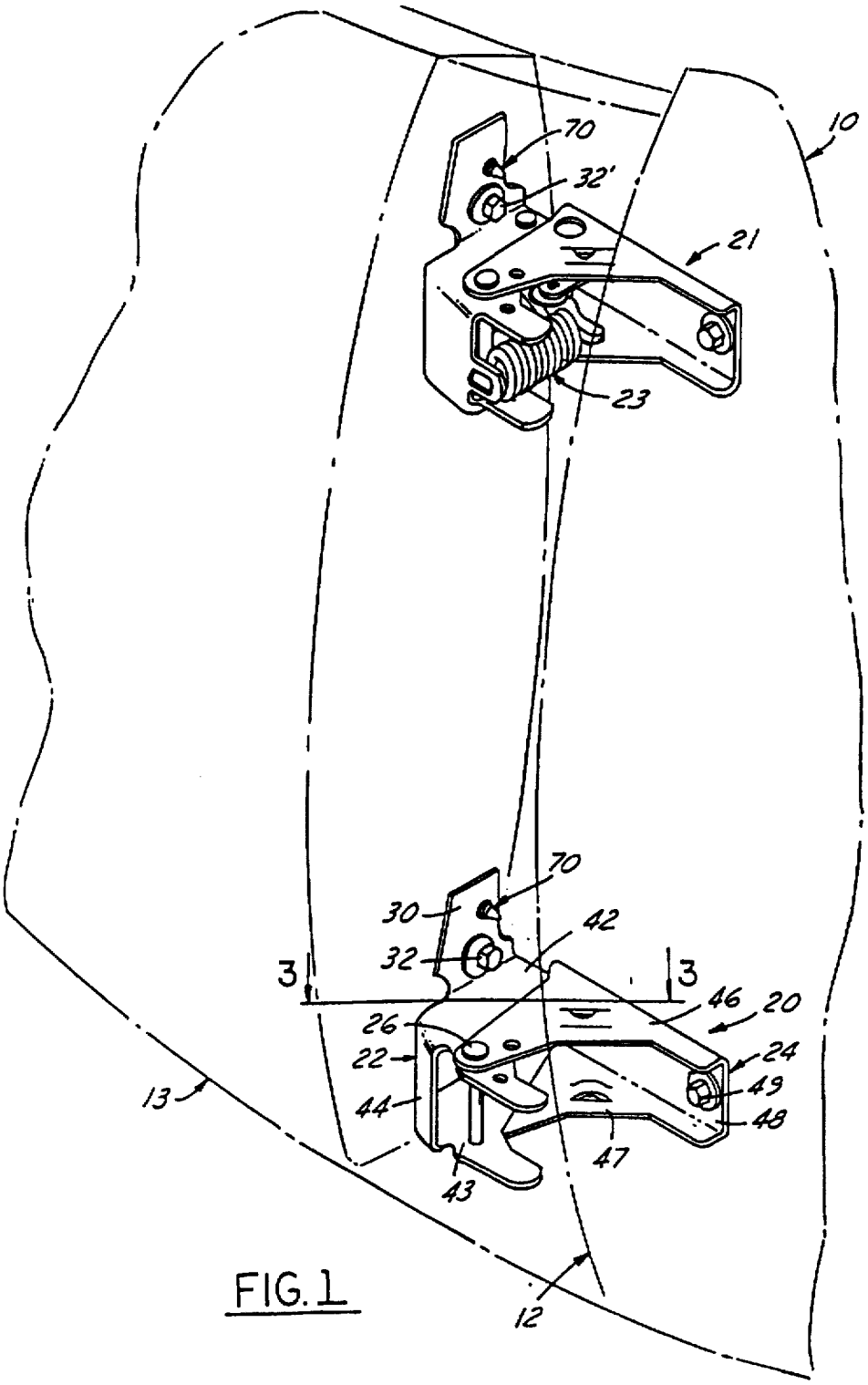
FIG. 1 is a fragmentary perspective view of a door mounted on a vehicle body by upper and lower hinge assemblies in accordance with the present invention.
Figure 3:
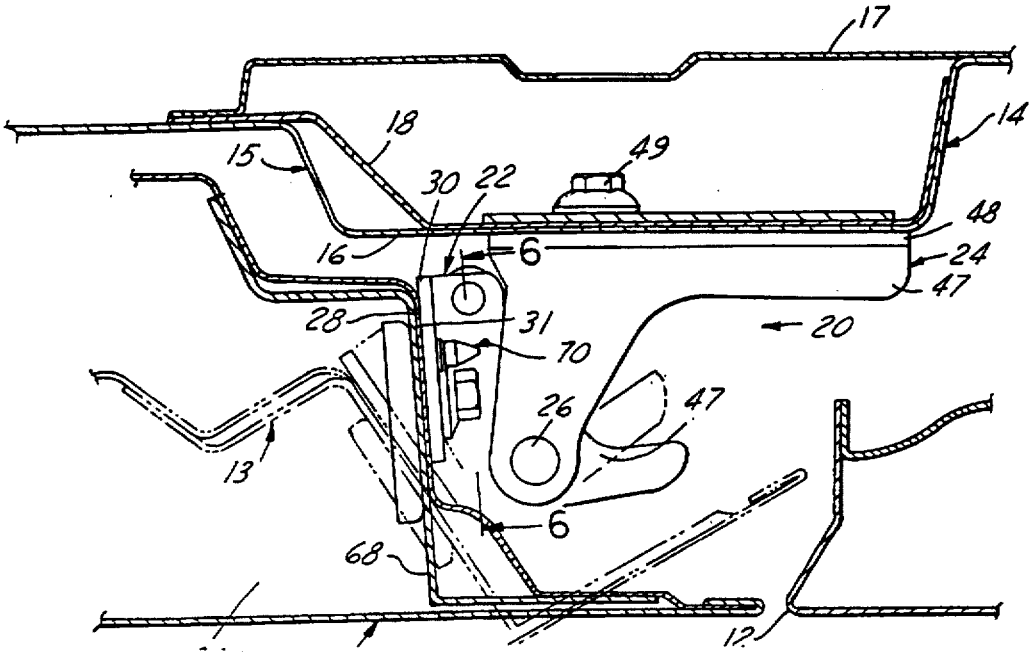
FIG. 3 is a fragmentary horizontal sectional view taken on the line 3—3 of FIG. 1.

Referring now to FIG. 1 of the drawings, a portion of a vehicle body, generally indicated in phantom at 10, provides a front door opening 12 for a vehicle door 13. FIG. 3 shows the opening, including a box-shaped hinge pillar 14, partially defined by an outer body U-section panel 15, formed with a longitudinally extending hinge mounting wall 16, strengthened by welded-in U-section inner and outer reinforcements 17 and 18. As seen in FIG. 1, the pillar mounting wall 16 supports a lower hinge assembly 20 and an upper hold-open hinge assembly 21. The hinge assemblies are substantially identical except for the addition of a hold-open cam spring device 23 in the upper hinge assembly 21. As the upper and lower hinge assemblies are mounted in the same manner, only the lower hinge assembly 20 will be shown and described in detail. The same reference numerals will be used to describe the same parts on the upper hinge assembly 21, with the exception that they will be primed.

Figure 7:
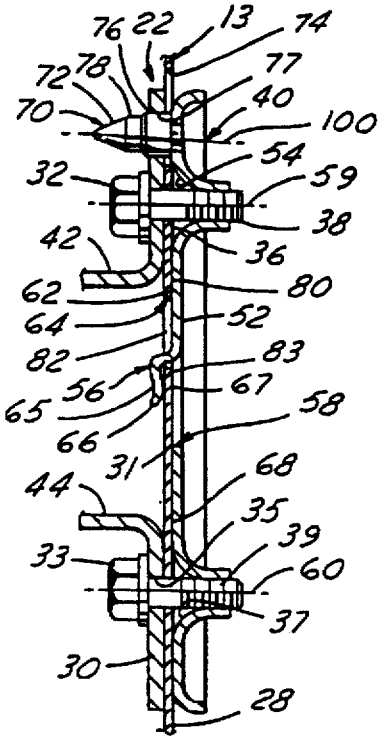
FIG. 7 is a fragmentary vertical sectional view taken on the line 7—7 off FIG. 6.

FIG. 3 shows the hinge assembly 20 including a door hinge 22 and a body hinge 24 connected by hinge pin 26. The door hinge 22, fixed to door forward hinge flange 28, comprises an upright metal web 30 which lies in face-to-face relation with forward mounting surface 31 of door flange 28. As seen in FIG. 7, the door hinge 22 is mounted to the door flange 28 by bolts 32 and 33 extending through associated holes 34 and 35 in the web 30 and aligned upper and lower adjustment slots 36 and 37 in the door flange 28 for engagement with aligned threaded bores 38 and 39 of a tapping plate 40.

With reference to FIG. 7, formed integrally with the upper and lower margins of the web 30 are upper and lower hinge plates 42 and 43, shown in FIG. 1 joined by vertical strap portion 44, which plates extend forwardly when the door 13 is in its closed position. As seen in FIG. 1, the plates 42 and 43 are straddled by upper and lower plates 46 and 47 of the body hinge 24. FIG. 3 shows the body hinge parallel plates 46 and 47 extending outboard from bight plate 48 which is fixed to body pillar mounting wall 16 by bolts 49.

Figure 2:
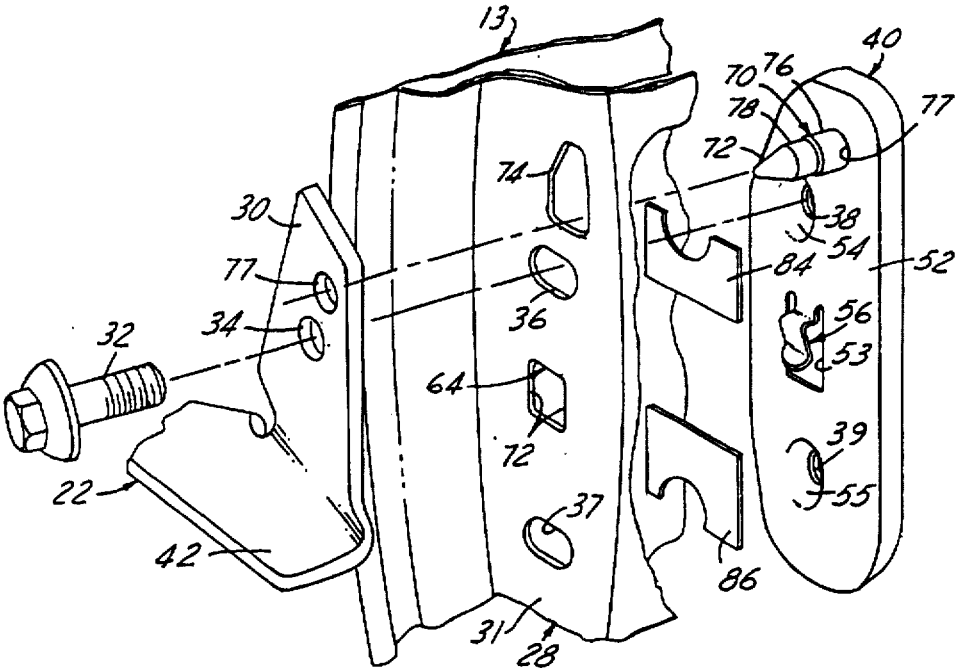
FIG. 2 is a fragmentary exploded perspective view of the hinge assembly mounting arrangement.
Figure 5:
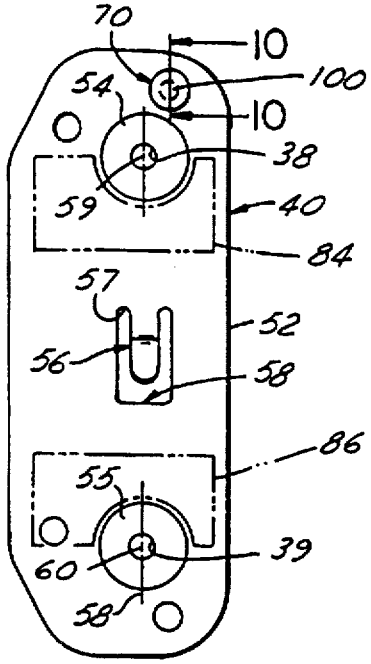
FIG. 5 is a detail plan view of a tapping plate mating face.

With reference to FIGS. 2 and 5 the tapping plate 40, stamped from spring sheet steel material, consists of a base 52 formed with upper and lower deep drawn conical extrusion pockets 54 and 55, terminating in associated internally threaded upper and lower bores 38 and 39. An elongated hook-shaped retaining tab member 56 is shown lanced-out from an upper edge 57 of a central generally rectangular cutout 53 formed in the base 52, intermediate to the upper and lower conical pockets 54 and 55.

As seen in FIG. 5, the lanced tab member 56 projects downwardly from cutout upper edge 57 and is symmetrically disposed about a vertical plane of symmetry, defined by vertical construction line 58. It will be noted that the plane includes principal axes 59 and 60 of respective upper and lower extruded bores 38 and 39.

Figure 10:
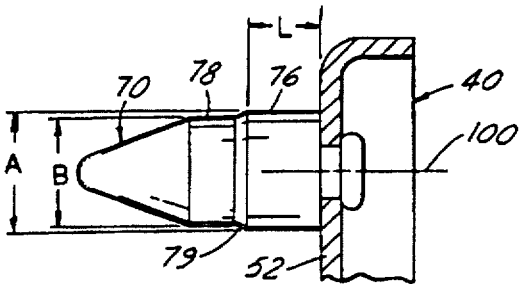
FIG. 10 is an enlarged fragmentary vertical sectional view, partly in elevation, taken on the line 10—10 of FIG. 5.

Referring to FIGS. 5 and 7, a tapered locator pin is shown at 70 mounted adjacent the tapping plate upper and edge with the pin off-set from the vertical centerline 58 of the plate bores 38 and 39. FIG. 7 shows the locator pin 70 formed at its distal free end with a tapered nose portion 72 allowing ready passage through upper vertically elongated clearance aperture 74 in the door hinge flange 28. Referring to FIG. 10, the pin 70 has a proximate portion 76 of predetermined diameter "A" sized for close tolerance fit in a net locator hole 77 provided in door hinge web 30.

As best seen in FIGS. 7 and 10, the pin portion 76 extends a predetermined axial length "L"substantially equal to, but slightly greater than, the combined thicknesses of the door flange 28 and the hinge web 30 for substantially coextensive positioning relative to the flange clearance aperture 74 and the web net hole 77. An intermediate pin portion 78, shown offset from the proximate pin portion 76 by an inwardly sloped chamfer 79, has a predetermined reduced diameter "B" allowing for paint build-up. It will be appreciated that painting of the exposed reduced diameter pin portion 78, such as by an assembly line painting system, will not interfere with the removal of the door hinge during subsequent door on door off operations.

Figure 4:
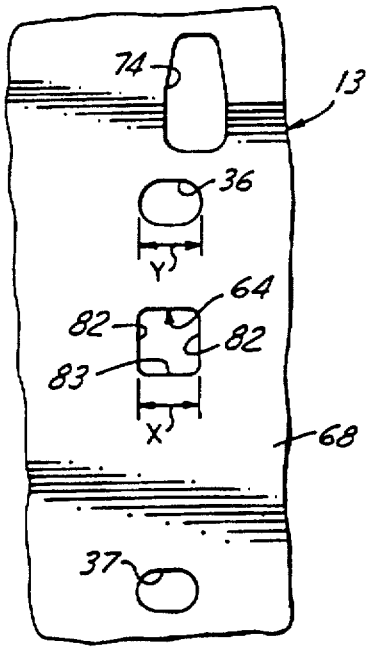
FIG. 4 is a fragmentary plan view of a door hinge panel outer surface adapted to receive a door hinge.

The tapping plate tab member 56, as shown in FIG. 7, projects outwardly from its mating face 62 and is adapted to be received in rectangular hinge panel tab opening, indicated generally at 64 in FIG.4. It will be observed in FIG. 7 that the hook-like tab member 56 is formed with a downwardly and inwardly angled hook portion 65, which terminates in an outwardly angled lead-in lip 66. The juncture of the tab member hook and lip portions 65 and 66 define an inwardly projecting radiused bend 67 enabling the resilient tab member to readily slid on the door flange inner surface 68 for up/down and in/out door adjustment on the door 13 in the body door opening.

An assembly line operator installs the tapping plates by taking two of the plates and reaching into a door cavity, shown at 80 in FIG. 3, and hanging each tapping plate tab member 56 to the door flange inner surface 68. This is accomplished by the operator sliding each tapping plate downwardly until its tab member 56 initially projects outwardly through its associated tab opening 64. Further downward movement causes each tab member to hooks-over the outer surface 31 of the door flange with the tab bend 67 resiliently urged into spring biased contact with the flange outer surface 31.

It will be observed in FIG. 4 that the hinge flange tab opening 64 has a predetermined width "X", of the order of 15 mm, equal to length "Y" of upper and lower slots 36 and 37. As the tab member 56 has a predetermined width "Z" of the order of 9 mm, it will be appreciated that, upon the operator's initial installation, the tab member 56 in the tab opening 64, the tapping plate 40 is adapted to "float" on the door flange inner surface 68 between tab opening vertical side edges 82 providing +/– cross car 3.0 mm in/out adjustment for fitting of the door 13 to the vehicle body.

Figure 6:
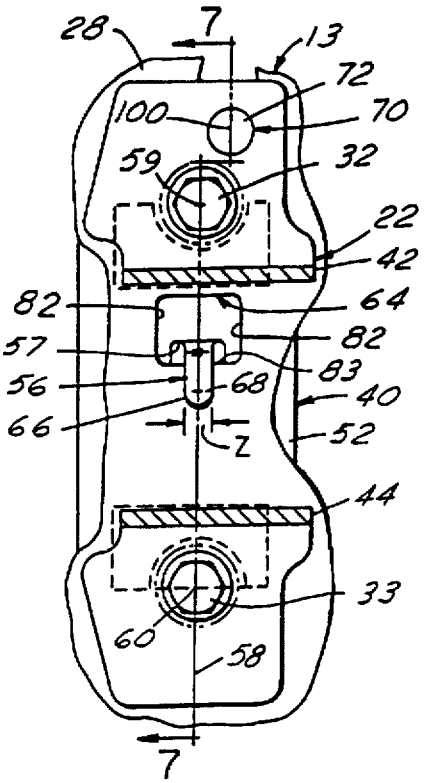
FIG. 6 is a fragmentary vertical sectional view, with parts broken away, taken on the line 6—6 of FIG. 3.

FIG. 6 shows the tab aperture 64 having its lower horizontal edge 83 spaced a predetermined vertical dimension below cutout upper edge 57. Further, the upper and lower slots 36 and 37 are oversize vertically to allow the tapping plate and door hinge 22 to conjointly slide vertically relative to the door flange 28, providing vertical tolerance adjustment of the door to the vehicle body as well as cross-car adjustment.

Referring to FIG. 2, upper and lower die cut patches of a thermosetting film adhesive 84 and 86 are adapted to be pre-applied by a roller to the tapping plate face 62. In FIG. 5 the upper and lower sticky tape-like patches 84 and 86 are shown located adjacent to their associated upper and lower conical pockets 54 and 55. In the disclosed embodiment, the film adhesive patches 84 and 86 comprise a thermosetting, nonvolatile, modified epoxy film adhesive having the designation "Scotch-Weld" Structural Adhesive AF-126, supplied by the Adhesives, Coatings and Sealers Division of the 3M Company located in St. Paul, MN 55144.

Figure 8:
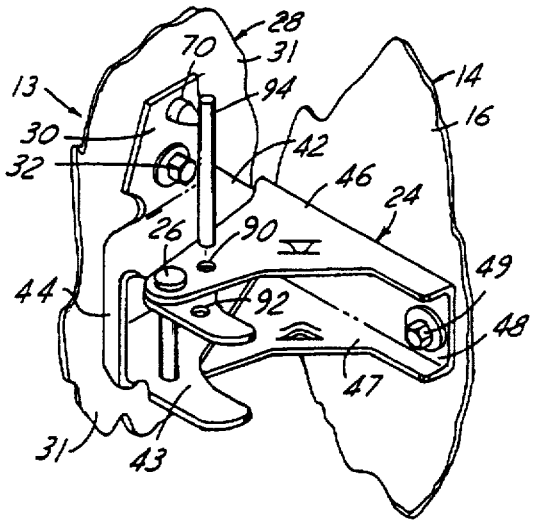
FIG. 8 is a fragmentary perspective view of the lower hinge assembly showing the hold open pin prior to engagement with the hinge.
Figure 9:
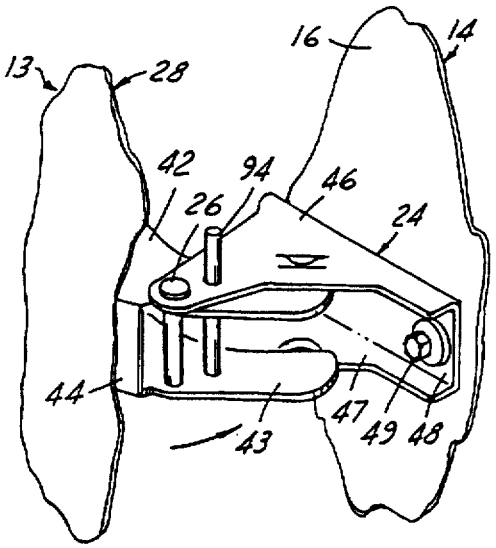
FIG. 9 is a view similar to FIG. 8 showing the vehicle door pivoted to its full open position with the hold open pin in its hinge locking position.

In FIG. 8 the lower hinge assembly 20 is shown pivoted to its door closed precise mounting position wherein the door flange 28 extends transversely relative to the longitudinally extending body pillar wall 14. The body hinge upper plate 46 has a lock hole 90 adapted for alignment with a lock hole 92 in the door hinge upper plate 42. Upon the door being pivoted to its full-open position of FIG. 9, the aligned holes 90 and 92 receive a locking peg 94 preventing the lower hinge from rotating. The upper hinge 21 remains in its full open position because of its hold-open cam spring device 23. Thus, the lock peg 94 provides an assembly aid adapted for use for door remounting during vehicle production.

After the body mounted doors travel through the paint system, which cures the epoxy film to the tapping plates and door inner surface 31, the doors are transported to a trim area. In the trim area, the doors are removed from the body to be trimmed on a separate line remote from the body line. After trimming, the doors are rejoined or docked to the vehicle by a special fixture.

The operator inserts the lock peg 94 in the lower hinge and a door is moved to the vehicle and into the upper and lower hinge assemblies. The upper 70' and lower 70 tapered pins extend forward from the door flange front enabling the operator to see each tapered pin and their associated net holes in the door hinge webs. The tapered pins allow for approximately +/−5.0 mm misalignment of the door assembly relative to the hinge assemblies, in elevation and cross-car directions, respectively, for friendly docking.

Upon the door being moved forward, the door flange surface 31 is urged into flush seating contact with each door hinge web, the fixture is locked and the operator drives upper door hinge upper bolt 32'. An operator at a next station drives the lower screw (not shown) for the upper hinge and the two remaining bolts 32 and 33 of the lower hinge. Lastly the lock peg 94 is removed allowing the door to be closed.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An arrangement for precise mounting of a vehicle door hinge assembly, comprising a door hinge pined to a body hinge, between a vehicle body mounting surface and a door flange to achieve precise door and body alignment, said arrangement comprising:

a door flange, with inner and outer surfaces, having upper and lower transversely elongated clearance slots of predetermined length with their centers located on a vertical axis of symmetry, said slots vertically spaced a predetermined dimension for receiving attachment screws of a door hinge web adapted for mounting to said outer surface, and a rectangular tab opening in said flange symmetrically disposed on said axis intermediate said slots, a locator pin, said flange having a clearance aperture adapted for receiving said locator pin;

a tapping plate having a base, a thermosetting film adhesive on one mating face of said base adapted for flush contact with said flange inner surface, said tapping plate base formed with upper and lower bores, a central resilient retaining tab lanced from said base adapted to resiliently hook-over an edge of said rectangular tab opening, so as to urge said plate face in flush sliding contact with said flange inner surface, together with said locator pin projecting through said flange clearance aperture;

said locator pin being received in said clearance aperture, said door hinge is loose fitted to said flange outer surface by a hinge screw extending through each clearance slot for reception in an associated tapping plate bore, whereby said resilient tab allows said tapping plate and said door hinge to adjustably slide on said flange for precise alignment of the door and body panel; whereby upon said hinge screws being tightened, said film adhesive is subjected to a predetermined curing temperature which bonds said tapping plate face to said flange inner surface, and whereby said locator pin and said clearance aperture establishing a location of said door hinge for the precise re-mounting of the door.

2. The arrangement as set forth in claim 1 wherein said thermosetting film adhesive is an epoxy film adhesive.

3. The arrangement as set forth in claim 1 wherein said thermosetting film adhesive comprises a first film secured intermediate said upper bore and said central tab and a second film secured intermediate said lower bore and said central tab.

4. The arrangement as set forth in claim 1 wherein said body mounting surface is in the form of a longitudinally extending vehicle body pillar mounting surface and said door flange is in the form of a transversely extending door hinge flange.

5. The arrangement as set forth in claim 1 wherein said locator pin is in the form of a tapered pin located adjacent an upper edge of said tapping plate.

6. The arrangement as set forth in claim 1 wherein said locator pin comprises a proximate portion of predetermined diameter sized for minimal tolerance fit in said net hole, said proximate portion having a predetermined axial length substantially equal to but slightly greater than the combined thicknesses of said door flange and said door hinge web, said proximate portion joined to a distal tapered nose portion by an intermediate pin portion of reduced diameter, said intermediate portion is adapted, upon being coated with paint, obviating interference with the removal of said door hinge web from said door flange.

7. The arrangement as set forth in claim 1 wherein each said tapping plate bore in the form of a deep drawn conical extrusion pocket terminating in an axially extending neck having an internally threaded bore.

8. The arrangement as set forth in claim 1 wherein said tab comprises an outwardly extending radiused portion formed with a downwardly and inwardly angled hook portion terminating in an outwardly angled lead-in lip portion, and wherein the juncture between said hook portion and said lip portion defines a line contact bend.

9. The arrangement as set forth in claim 1 wherein said elongated slots have a predetermined lateral dimension which is substantially equal the width of said tab opening.

10. The arrangement as set forth in claim 9 wherein said tab has a predetermined width about one-half the width of said tab opening enabling said door hinge an said tapping plate to be laterally adjusted relative to said door hinge flange.

11. The arrangement as set forth in claim 10 wherein said tab has a width of the order of 9 mm and said tab opening has a width of the order of 15 mm.

12. The arrangement as set forth in claim 1 wherein said locator pin has its principal axis positioned a predetermined vertical dimension above said tapping plate upper bore principal axis, and said flange clearance aperture is spaced above said upper slot.

* * * * *